US007545265B2

(12) United States Patent
Fang

(10) Patent No.: US 7,545,265 B2
(45) Date of Patent: Jun. 9, 2009

(54) MANAGEMENT SYSTEM WITH REAL-TIME INTERACTION FOR ENVIRONMENTAL MONITORING AND METHOD THEREOF

(75) Inventor: Hsin-Fa Fang, Longtan Township, Taoyuan County (TW)

(73) Assignee: Atomic Energy Council - Institute of Nuclear Energy Research, Taoyuan County (TW)

( * ) Notice: Subject to any disclaimer, the term of this patent is extended or adjusted under 35 U.S.C. 154(b) by 358 days.

(21) Appl. No.: 11/641,795

(22) Filed: Dec. 20, 2006

(65) Prior Publication Data

US 2008/0150736 A1 Jun. 26, 2008

(51) Int. Cl.
*G08B 1/08* (2006.01)

(52) U.S. Cl. ..... 340/539.13; 340/539.16; 340/539.17; 340/540; 340/589; 340/592; 702/184; 702/188

(58) Field of Classification Search ..... 340/539.13, 340/539.16, 539.17, 540, 589, 592; 702/184, 702/188

See application file for complete search history.

(56) References Cited

U.S. PATENT DOCUMENTS

2006/0020427 A1* 1/2006 Kahn et al. ..... 702/188

2006/0031040 A1* 2/2006 Wolfe ..... 702/184

* cited by examiner

*Primary Examiner*—Tai T Nguyen
(74) *Attorney, Agent, or Firm*—Rosenberg, Klein & Lee

(57) ABSTRACT

The present invention related to a management system with real-time interaction for environmental monitoring and a method thereof. The management system for environmental monitoring includes a server system, which includes a data processing apparatus and a first management apparatus. The data processing apparatus executes collecting and evaluating monitored data, and importing and exporting monitoring management criteria as well as analyzing and comparing the monitored data and the automatically adjusting the monitoring management criteria. The management system for environmental monitoring also includes a monitoring apparatus, which receives data of monitoring operations transmitted by the first management apparatus via a network, and transmits the monitored data produced in environmental monitoring to the first management apparatus. The data processing apparatus analyzes and compares the monitored data received by the first management apparatus for producing resultant analysis data to the first management apparatus. Thereby, the monitoring apparatus can receive real-timely the resultant analysis data transmitted by the first management apparatus.

35 Claims, 7 Drawing Sheets

MANAGEMENT SYSTEM WITH REAL-TIME INTERACTION FOR ENVIRONMENTAL MONITORING AND METHOD THEREOF

FIELD OF THE INVENTION

The present invention relates generally to a management apparatus, and particularly to a management information system with real-time interaction for environmental monitoring, which integrates evaluation and monitored results by real-time interaction and by performing analysis and comparison for enhancing performance of environmental monitoring.

BACKGROUND OF THE INVENTION

In modern days, information technology (IT) and network communication technology develop rapidly. The level of their influences is getting increasingly diverse. No matter government organizations, companies, or academic institutions, applications of IT and network communications are prevailing. For example, the portal sites of government organizations, the commercial websites of various firms, and the academic websites of all kinds of schools are applications of IT combined with network communications at present day. Currently, people have more and more awareness and common senses of environmental protection, which make people take account of influences of environmental pollution. In order to acquire various environmental monitoring with emphasis on on-site techniques, at present, a mobile environmental radiation monitoring system is developed, which can collects and display monitored results, and can integrate and analyze data as well. However, the system stresses on displaying the monitored results only, as shown in FIG. 1.

FIG. 1 shows a block diagram of a management system for environmental monitoring according to the prior art, which includes a management unit 10 and a monitoring apparatus 20. The management unit 10 connects to the monitoring apparatus 20 by way of a network 30. The monitoring apparatus 20 transmits monitored results to the management unit 10 via the network 30. When the monitoring apparatus 20 executes monitoring operations in actual environments, because of limitations imposed by environmental changes in the field, the monitored results of the monitoring apparatus 20 are affected by said environmental changes. Even worse, when the actual environments exceed the threshold of harming human bodies but the monitored results show that the threshold is not reached, the monitoring operators will be hurt due to the false monitored results. In particular, the on-site monitoring personnel will be polluted or even hurt owing to severe pollution in the scenes of fire accidents of chemical factories, explosions caused by car accidents of transport carriers for chemical materials, or chemical and radiative terror attacks which draw international attention.

Thereby, pollution on the on-site monitoring personnel caused by environmental changes in the field will force the monitoring operations to stop, which further results in inability in execution of rescue actions for environmental pollution according to the monitored results. Hence, it is necessary for current management system for environmental monitoring to apply the information technology and network communication technology flourishing at present. Thereby, various environmental changes can be adapted for guiding the monitoring personnel to avoid polluted environments.

Accordingly, a novel management system for environmental monitoring for solving the problems described above can not only improve the drawbacks of the management system for environmental monitoring in the prior art, but also give more accurate monitored results by means of real-time interactive adjustments. Thereby, monitoring personnel will be free from pollution thanks to the real-time warning on polluted environments. Consequently, a management system with real-time interaction for environmental monitoring according to the present invention can solve the problems described above.

SUMMARY

The purpose of the present invention is to provide a management system with real-time interaction for environmental monitoring, which analyzes monitored environmental quality integrally, and manages planning and area of monitoring operations. Monitoring of environmental quality can adjust the planning and area of monitoring operations interactively. If the analyzed monitored results of the environmental quality exceeds a threshold standard, it can be an index of warning.

Another purpose of the present invention is to provide a management system with real-time interaction for environmental monitoring and a method thereof, which provide a monitoring apparatus of the management system for environmental monitoring for monitoring in a safe area of monitoring operations. When a data processing apparatus analyzes the monitored data of the monitoring apparatus and found that the monitored data exceeds threshold data, a management apparatus is forced to transmit a warning data to the monitoring apparatus for transmitting a warning signal, or for instructing to evacuate current area of monitoring operations for avoiding dangers.

Another purpose of the present invention is to provide a management system with real-time interaction for environmental monitoring and a method thereof, wherein after a server system of the management system for environmental monitoring receives monitored data of the monitoring apparatus, the server system transmits analysis data to the monitoring apparatus according to the analysis results of the monitored data. Thereby, the monitoring apparatus can acquire real-time analysis results.

The management system with real-time interaction for environmental monitoring according to the present invention includes a monitoring apparatus and a server system. The server system includes a data processing apparatus, which analyzes monitored data produced by the monitoring apparatus to generate resultant analysis data, and adjusts real-timely the area of monitoring operations required by monitoring apparatuses at different geographic locations, and a first management apparatus, which connects to the data processing apparatus and to the monitoring apparatus via network for sending data for monitoring operation, which includes planning and area of monitoring operations. The monitoring apparatus monitors environmental quality and produces monitored data according to the data of monitoring operations sent by the first management apparatus, transmits the monitored data to the first management apparatus, and receives resultant analysis data transmitted by the first management apparatus. In addition, the management system for environmental monitoring according to the present invention further includes a second management apparatus, which transmits the data of monitoring operations and the resultant analysis data to the monitoring apparatus, and transmits the monitored data received from the monitoring apparatus to the first management apparatus.

DETAILED DESCRIPTION

In order to make the structure and characteristics as well as the effectiveness of the present invention to be further understood and recognized, the detailed description of the present invention is provided as follows along with preferred embodiments and accompanying figures.

Figure 1:
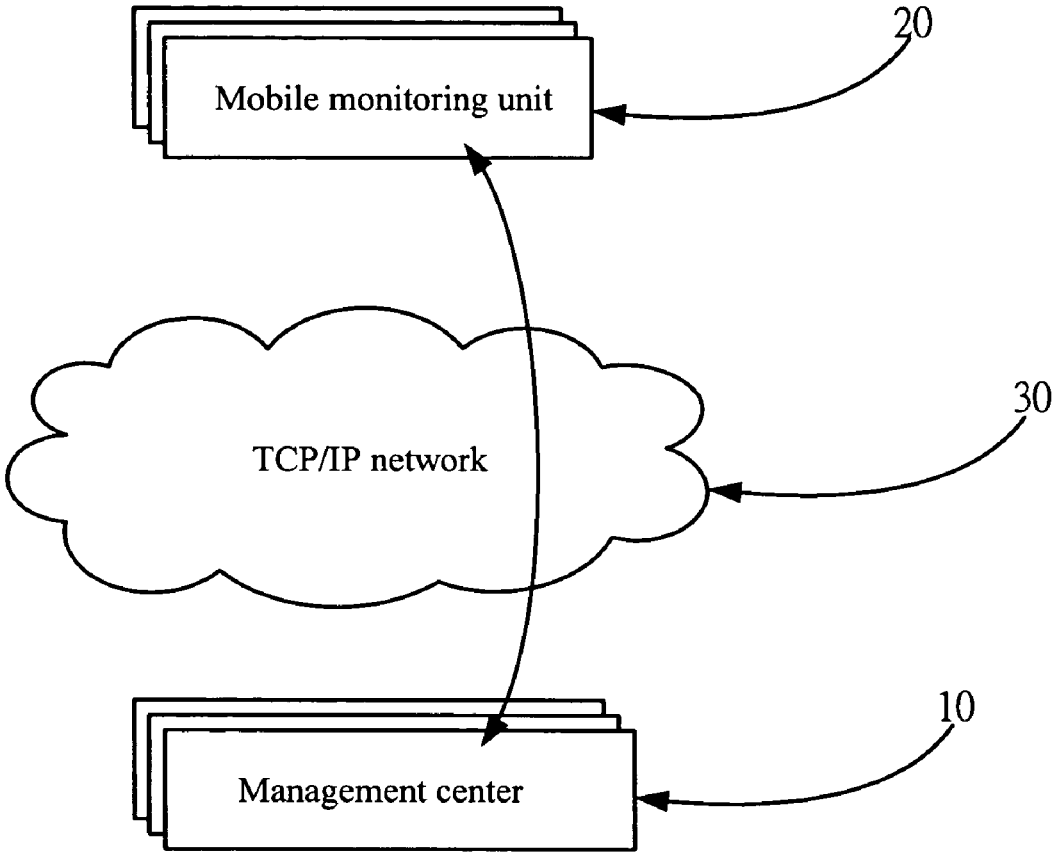
Figure 1 (PRIOR ART)
FIG. 1 shows a block diagram of a management system for environmental monitoring according to the prior art.
Figure 2:
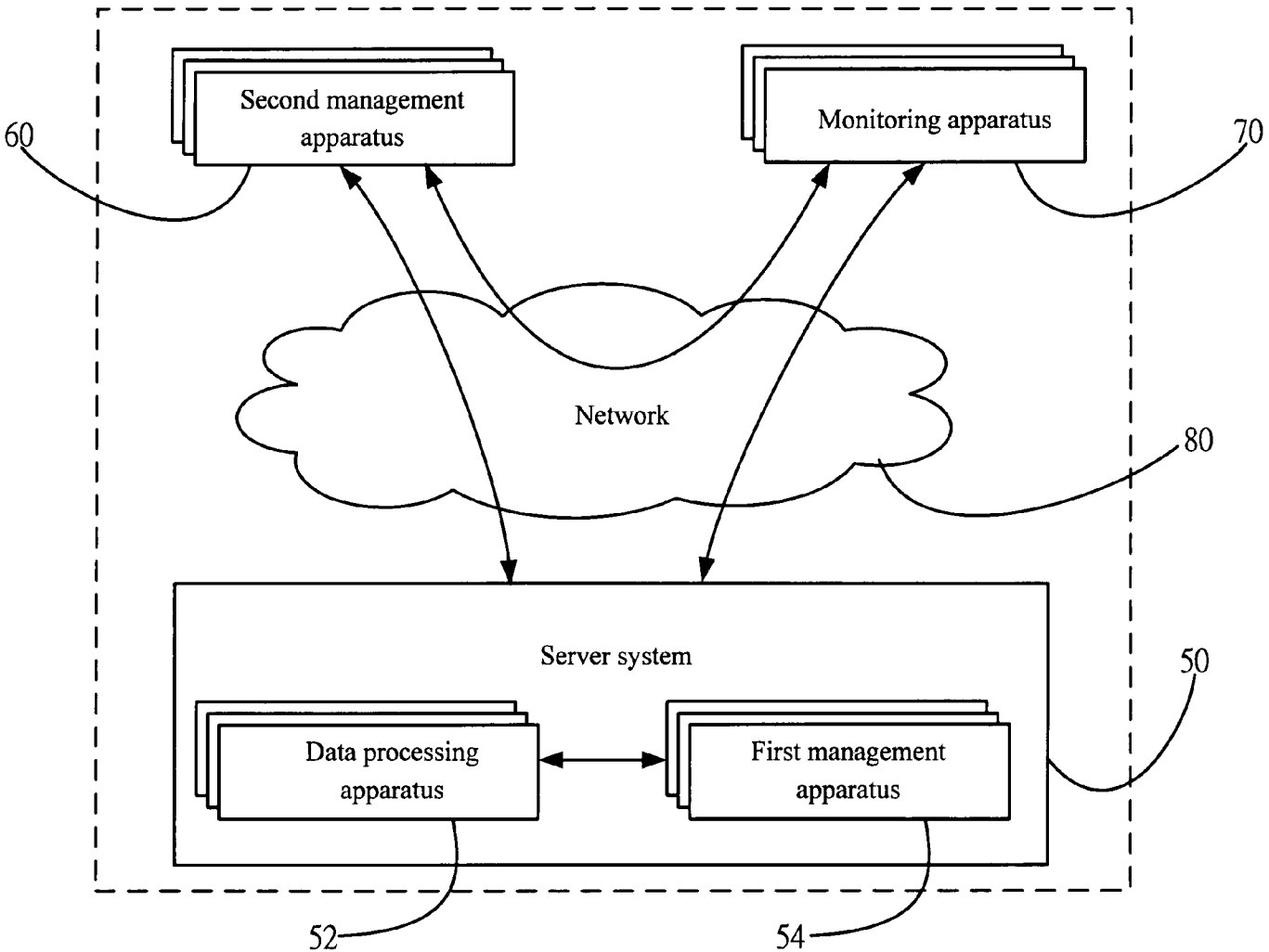
FIG. 2 shows a block diagram of a management system for environmental monitoring according to a preferred embodiment of the present invention.

FIG. 2 shows a block diagram of the management system for environmental monitoring according to a preferred embodiment of the present invention. As shown in the figure, the management system with real-time interaction for environmental monitoring 40 according to the present invention includes a server system 50, a second management apparatus 60, a monitoring apparatus 70, and a network 80. The server system 50 includes a data processing apparatus 52 and a first management apparatus 54. The first management apparatus 54 connects to the data processing apparatus 52, and to the second management apparatus 60 and the monitoring apparatus 70 by way of the network 80 for sending data to each other. The first management apparatus 54 verifies the received messages and data, and transmits the verified messages and data to the data processing apparatus 52 for performing data collection and analysis. The network 80 includes the Internet, the intranet, or a combination of both.

The monitoring apparatus 70 monitors an environmental quality, which includes an air quality, a radiation dose, or a water quality. The monitoring apparatus 70 produces monitored data according to the monitored result of the environmental quality, and sends the monitored data to the first management apparatus 54 via the network 80. The first management apparatus 54 transmits the monitored data to the data processing apparatus 52, which analyzes the monitored data and generates analysis data according to the analysis result. The data processing apparatus 52 transmits the analysis data to the first management apparatus 54, and transmits the analysis data to the monitoring apparatus 70 via the network 80. Besides, if the area of monitoring operations is close to the second management apparatus 60, the monitoring apparatus 70 can first transmit the monitored data to the second management apparatus 60, which, then, transmits the monitored data to the first management apparatus 54. In addition, the first management apparatus 60 transmits the analysis result of the monitored data to the monitoring apparatus 70 by way of the second management apparatus 60.

Figure 3:
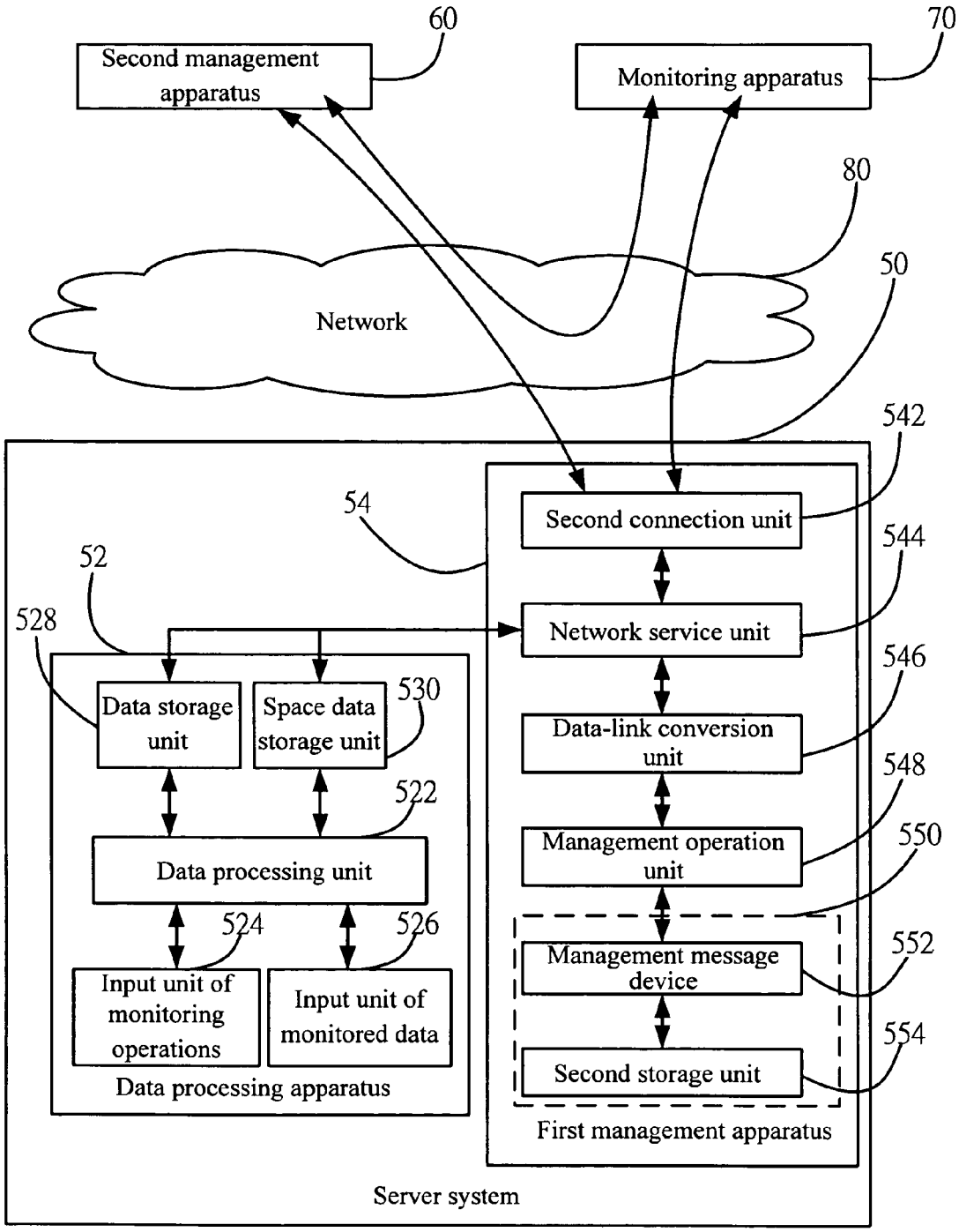
FIG. 3 shows a block diagram inside a server system according to a preferred embodiment of the present invention.

FIG. 3 shows a block diagram inside the server system according to a preferred embodiment of the present invention. As shown in the figure, the server system 50 according to the present invention includes the data processing apparatus 52 and the first management apparatus 54. The data processing apparatus 52 includes a data processing unit 522, an input unit of positioning management data 524, and an input unit of monitored data 526. Besides, the data processing apparatus 52 further includes a first storage unit, which includes a data storage unit 528 and a positioning data storage unit 530. The first management apparatus 54 includes a second connection unit 542, a network service unit 544, a data-link conversion unit 546, a management operation unit 548, and a management unit 550. The management unit 550 includes a message device 552 and a second storage unit 554. The input unit of positioning management data 524 is used for inputting positioning management data to the data processing unit 522, where the positioning management data includes environmental evaluation threshold data and positioning management data. Thereby, the data processing unit 522 can convert them into management information geographic map layers and can further analyze and manage the monitored data and the positioning data stored in the data storage unit 528 and the positioning data storage unit 530.

For descriptive positioning management data, the data processing unit 522 converts the descriptions of monitoring operations input by the input unit of positioning management data 524 to corresponding threshold data and positioning management data for storing to the data storage unit 528 and the positioning data storage unit 530. The message device 552 produces corresponding data of monitoring operations according to the positioning management data provided by the second storage unit 554 and the data processing apparatus 52. The produced data of monitoring operations includes the management operation unit 548, which determines the operation modes of the monitoring apparatus 70, for example, automatic and manual operation modes. After the data of monitoring operations produced by the message device 552 is converted to the corresponding data-link format readable by the monitoring apparatus 70 by way of the data-link conversion unit 546, it is transmitted to the second management apparatus 60 and the monitoring apparatus 70 by the network service unit 544 via the second connection unit 542. In addition, the monitored data sent back by the monitoring apparatus 70 is transmitted to the data-link conversion unit 546 by the second connection unit 542 for verifying integrity and rationality thereof. The management operation unit 548 displays the operational status of the monitoring apparatus 70, which uses different font colors and descriptions as basis of distinguishing online and offline.

To continue, the second management apparatus 60 connects to the second connection unit 542 via the network 80. Thereby, it can login to the network service unit 544 by way of the second connection unit 542. When the second management apparatus 60 completes login, it can connect to the management apparatus 54 via through the network service unit 544 for inquiring the data storage unit 528 and the positioning data storage unit 533 of the data processing apparatus 52. For example, the second connection unit 542 is a router, the network service unit 544 is a Microsoft web server, and the network service unit 544 connects to the second connection unit 542, which connect to the network 80 for making the second management apparatus 60 connect to the network service unit 544 through the network 80. Thereby, an environmental action module 70 can further login to the second management apparatus 60 for receiving the data of monitoring operations sent by the first management apparatus 54.

For example, the monitoring range of the monitoring apparatus 70 is three kilometers within a location A. Thereby, the decision personnel input the monitoring range of the monitoring apparatus 70 to the data processing apparatus 52 through the input unit of positioning management data 524. The data processing apparatus 52 reads threshold data and positioning management data from the data storage unit 528 and the positioning data storage unit 530 according to the monitoring range of the monitoring apparatus 70, and synthesizes an electronic map and marks the geographic location of the location A. Then, use the geographic location of the location A as the center and draw a circle with a radius of three kilometers as management information geographic map layers for being positioning management data of the monitoring apparatus 70. The message device 552 of the first management apparatus 54 combines the positioning management data of the data processing apparatus 52 according to the second storage unit 554 to produce data of monitoring operations of the monitoring apparatus 70 at the location A. Before the monitoring apparatus 70 starts monitoring, it first logins to the network service unit 544 through the network 80 for receiving the data of monitoring operations corresponding to the location A sent by the message device 552. Thereby, the monitoring apparatus 70 can monitor within the range three kilometers centered at the location A according to the data of monitoring operations.

Figure 4:
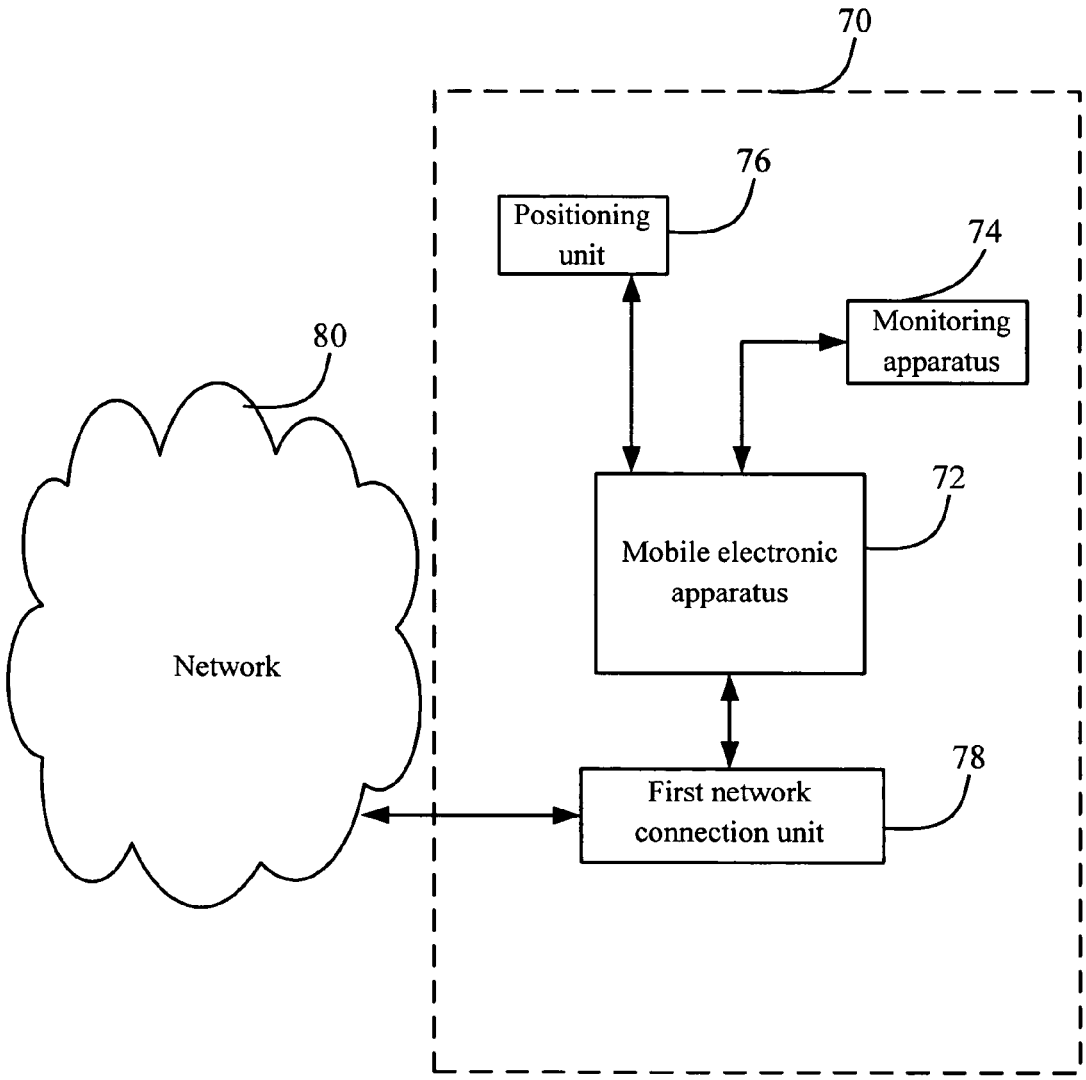
FIG. 4 shows a block diagram of a monitoring apparatus according to a preferred embodiment of the present invention.

FIG. 4 shows a block diagram of the monitoring apparatus according to a preferred embodiment of the present invention. As shown in the figure, the monitoring apparatus 70 according to the present invention includes a mobile electronic apparatus 72, which couples to a monitoring unit 74, a positioning unit 76, and a first connection unit 78. The monitoring unit 74 is an environmental monitoring instrument; the positioning unit 76 includes functions of a global positioning system (GPS); and the first connection unit 78 connects to the network 80. For example, the mobile electronic apparatus 72 is a personal digital assistant (PDA), and connects to the environmental monitoring instrument through an RS-232 serial port or a Bluetooth dongle. The main purpose of using the mobile electronic apparatus 72 with connection to the monitoring unit 74, the positioning unit 76, and the first connection unit 78 is for its enhanced portability. Thereby, the whole management system for environmental monitoring 40 can be more mobile, and the cost of installing monitoring apparatuses for each monitoring location can be saved. The mobile electronic apparatus 72 includes an operating program, which is used for activating the monitoring unit 74, the positioning unit 76, and the first connection unit 78, and for transmitting the monitored data and the positioning data collected by the monitoring unit 74 and the positioning unit 76 to the first management apparatus 54.

The monitoring unit 74 is an on-site direct-reading instrument. The monitoring unit 74 and the positioning unit 76 are placed together for collecting geographic location information of the monitoring unit 74 and time information, and for storing them as positioning data. For example, the monitoring unit can be a wind gauge or a high-pressure ion chamber (HPIC) for radiation monitoring. The PDA outputs signals by RS-232 or Bluetooth to select corresponding monitoring instrument according to the requests of monitoring items. The positioning unit 76 is a GPS receiver used for collecting geographic location information of the wind gauge or the HPIC and time information. The first connection unit 78 connects to the network 80; thereby the mobile electronic apparatus 72 connects to the management system for environmental monitoring 40 via the network 80 connected by the first connection unit 78 for receiving the data of monitoring operations, and for transmitting the monitored data and the positioning data collected by the monitoring unit 74 and the positioning unit 76.

Figure 5:
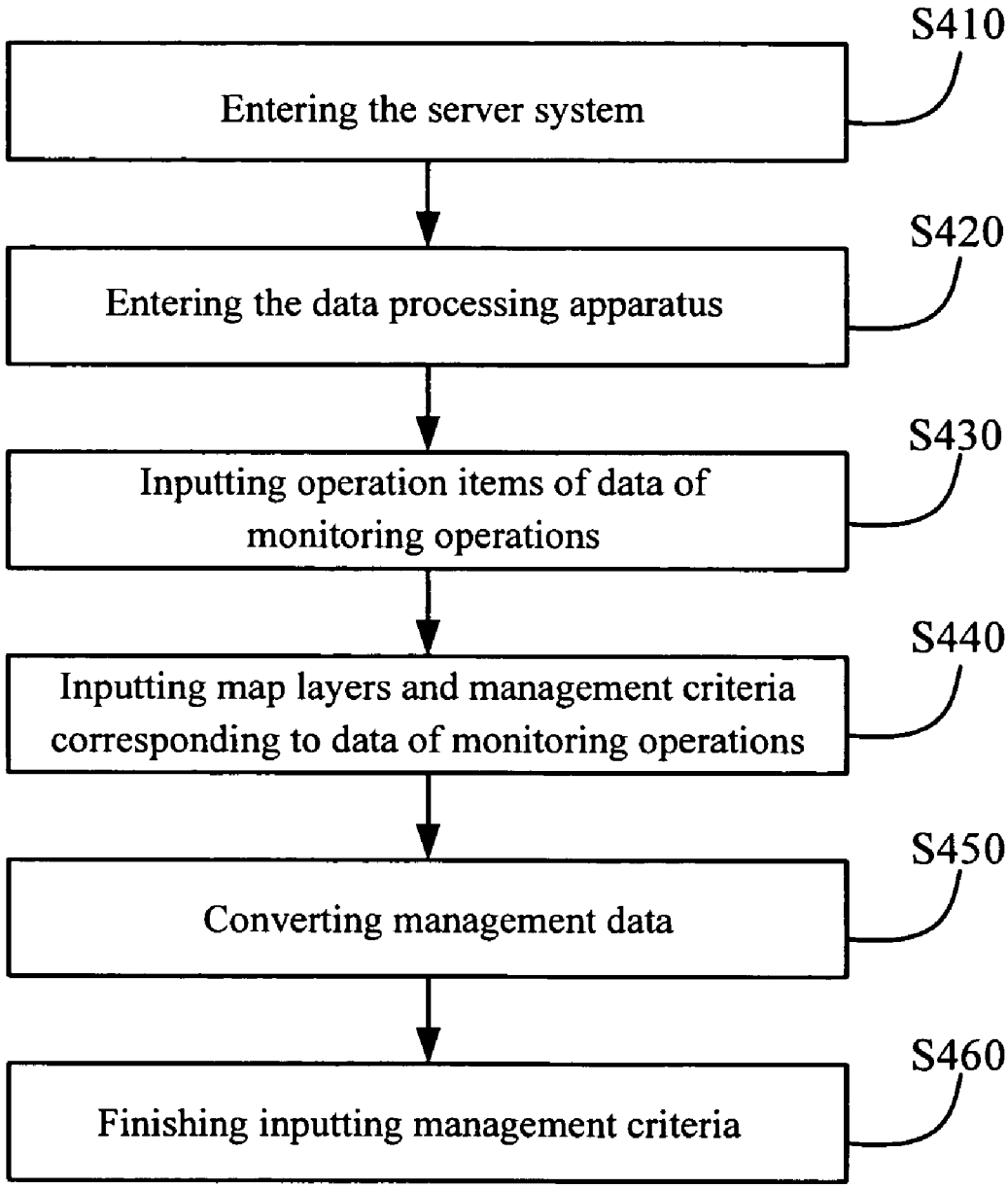
FIG. 5 shows a flowchart for configuring positioning management data according to a preferred embodiment of the present invention.

FIG. 5 shows a flowchart for configuring positioning management data according to a preferred embodiment of the present invention. As shown in the figure, the management system for environmental monitoring 40 according to the present invention let the evaluation or decision personnel perform evaluation and decision for environmental monitoring. When the evaluation or decision personnel wish to convert the action planning or guideline for environmental monitoring to an execution basis for environmental monitoring, first, as shown in the step S410, the management system for environmental monitoring 40 let the evaluation or decision personnel login to the first management apparatus 54 or the second management apparatus 60 of the server system 50 at their location. Then, as shown in the step S420, select the operational items to be inspected for assigning the monitoring apparatus 70 to be inspected and managed and execute inspection and management for environmental monitoring.

Next, as shown in the step S430, according to the evaluation or decision requests of the evaluation or decision personnel, input the threshold data, which includes a threshold value, a management method of the threshold value, a transmission form of instructions, a management method of the area of monitoring operations, warning of dangerous restricted area, and a distance for proximity warning. If the threshold value exceeds a tolerance value of the environmental quality, then a warning signal is sent to the monitoring apparatus 70. However, when the monitoring apparatus 54 becomes abnormal, the monitored values of the monitored data appear lower or appear same digits continuously. Thereby, in addition to inputting the threshold value, it is necessary to assign the management method of the threshold value to prevent situations when the monitoring apparatus is abnormal. The transmission form of instructions is the emergency warning method when the monitored values of the monitored data exceed tolerance values of environmental quality. The emergency warning method includes short messages and alarms. For example, normal transmission form of instructions is a short message with a single-beep alarm sending back to the monitoring apparatus 70. If the monitoring apparatus 70 does not receive the returned short message, then the short message is sent again with a fixed time interval until the monitoring apparatus 70 receives the returned short message.

The positioning management data is selected from geographic map layer data of a point, a line, a plane, or the whole area. The data processing apparatus 52 can assign to draw the geographic location of a line, a plane, or the whole area. If the data processing apparatus 52 has stored planned geographic map layer data, then the geographic map layers requested by the positioning management data. Hence, the area to receive environmental monitoring does not need to be assigned area of monitoring operations additionally in the geographic map layer data of the while area, but only has to stand on the assigned area of monitoring operations, which area is based on the planned geographic map layer data. In addition to giving warning alarm of danger when the monitoring apparatus 70 is about to enter a dangerous area, when the monitoring apparatus 70 escapes the area of monitoring operations assigned by the positioning management data, a warning sign of false location will be given to the monitoring apparatus 70. Thereby, the first management apparatus 50 needs to configure warning of false locations.

Then, following the step S440, if the data processing apparatus 52 has stored planned geographic map layers, which is assigned to be the positioning management data in the step S430, then drive the management system for environmental monitoring 40 to transmit a request signal after completing inputting the positioning management data for requesting the evaluation or decision personnel to select the geographic map layers and the file path required by the positioning management data. Then, following the step S450, after the geographic map layers required by the positioning management data is input, the management system for environmental monitoring 40 will convert the data format of the positioning management data automatically, and will store it to the positioning data storage unit 530. Besides, the management system for environmental monitoring 40 will produce data of monitoring operations real-timely in accordance with the threshold data and the positioning management data via the message device 552. If it is found that the positioning management data is missing or the format is not valid in the process of converting and file saving, it will be required to mend or re-input the positioning management data. At last, as shown in the step S460, inputting data of monitoring operations to the management system for environmental monitoring 40 is completed.

Figure 6:
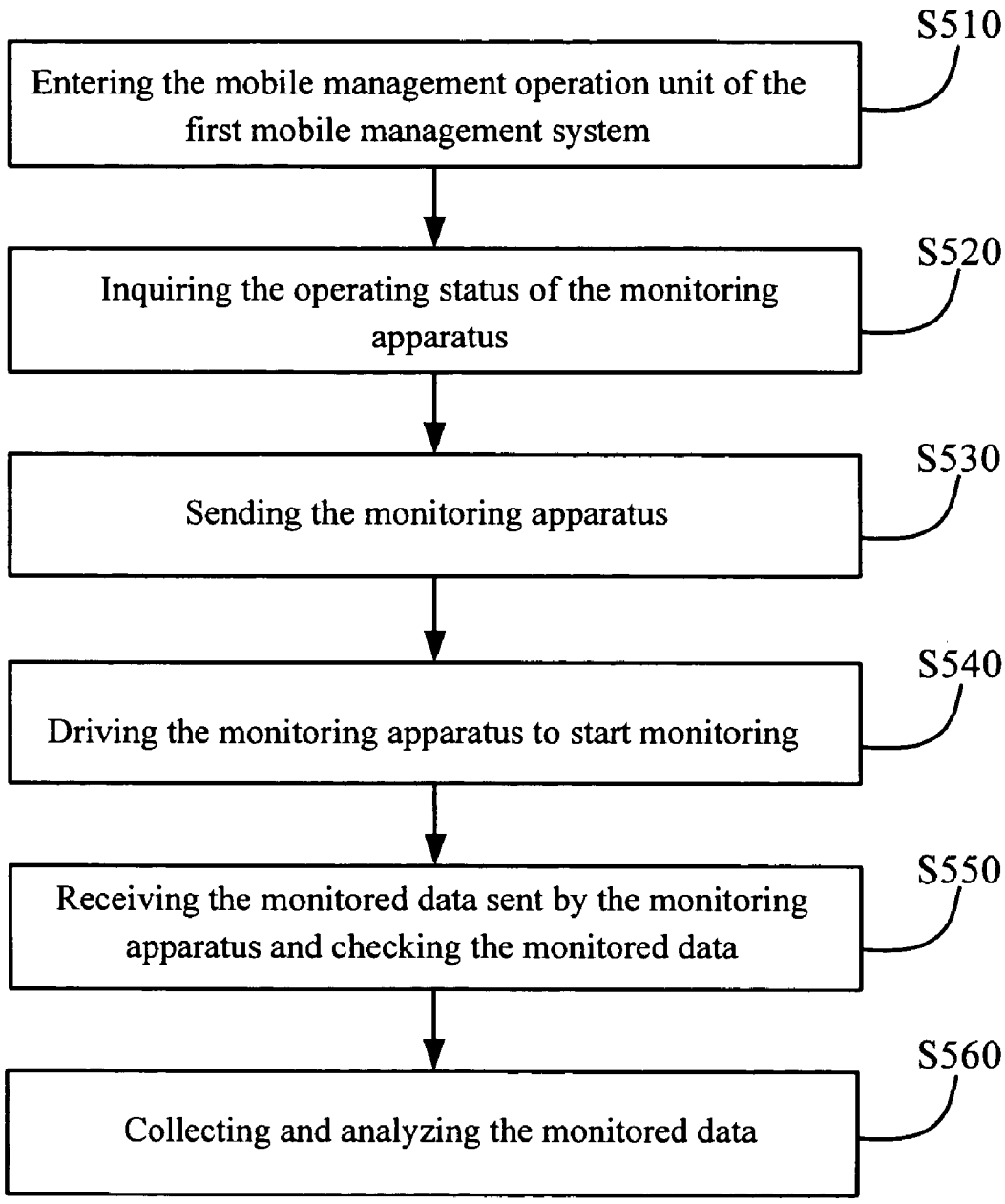
FIG. 6 shows a flowchart for environmental monitoring according to a preferred embodiment of the present invention.

FIG. 6 shows a flowchart for environmental monitoring according to a preferred embodiment of the present invention. As shown in the figure, when the server system 50 executes mobile management of the monitoring apparatus 70, the step S510 will be followed first to login to the server system 50 for entering the management operation unit 548 of the first management apparatus 54. As shown in the step S520, the message device 552 collects and integrates the data of monitoring operations and the positioning management data from the second storage unit 554 and the data processing apparatus 52 for providing the corresponding data of monitoring operations of the monitoring apparatus 70 and the corresponding geographic map layer data, and displaying integrally on the management operation unit 548. Thereby, currently executing data of monitoring operations and the online monitoring apparatuses 70 can be inquired for understanding environmental monitoring items, area of monitoring operations, and the installation locations of the corresponding monitoring apparatuses 70. If the corresponding monitoring apparatuses 70 of the environmental monitoring items are offline, then operator contact data of the monitoring apparatuses 70 stored in the second storage unit 552 is inquired for contacting and urging the operators to turn on the offline monitoring apparatuses 70 as soon as possible. Hence, the offline monitoring apparatuses 70 can join the current environmental monitoring operations soon.

Afterwards, as shown in the step S530, in accordance with the working requirements of environmental monitoring and currently online monitoring apparatuses 70, draw up the planning of monitoring operations for environmental monitoring as well as various monitoring items and corresponding area of monitoring operations for respective monitoring apparatuses 70, thereby the corresponding monitoring apparatuses of the planning of monitoring operations are dispatched to execute environmental monitoring. Then, following the step S540, drive the monitoring apparatuses 70 to start monitoring, wherein the monitoring apparatuses 70 are installed in the site to be monitored according to the planning of monitoring operations, and connect to the monitoring unit 50 and the positioning unit 76 automatically for be able to connect to the first management apparatus 54 of the server system 50 through the network 80 upon requests of working requirements, and then return the monitored data and the positioning data back to the first management apparatus 54. As shown in the step S550, the first management apparatus 54 receives the monitored data transmitted by the monitoring apparatus 70 by way of the second connection unit 522 through the network 80. When the monitoring apparatus 70 transmits the monitored data to the server system 50 through the network 80, the data-link conversion unit 546 will be driven to check integrity and rationality of the monitored data and the positioning data. Besides, the management operation unit 548 will be driven to display real-timely the monitored data of the corresponding monitoring apparatus 70. After the monitored data and the positioning data are checked to be integral and reasonable by the data-link conversion unit 546, they are then transmitted by the data-link conversion unit 546 to the input unit of monitored data 526. If the monitored data is not integral or not reasonable in comparison with the positioning data, then a message of replenishing the monitored data is sent to the monitoring apparatus 70 for driving the monitoring apparatus 70 to replenish the monitored data corresponding to the positioning data.

Then, following the step S560, input the monitored data and the positioning data checked by the data-link conversion unit 546 via the input unit of monitored data 526 to the data processing apparatus 52. Then, drive the data processing unit 522 of the data processing apparatus 52 to analyze and compare the monitored values of the monitored data and the positioning data, and store them to the data storage unit 528 and the positioning data storage unit 530, respectively, for feedbacking the analyzed and compared results of the monitored data to the message device 552 simultaneously.

For example, after the monitoring apparatus 70 completes monitoring in the assigned area of monitoring operations, the monitored data acquired by environmental monitoring is stored to the data storage unit 528 and the positioning data storage unit 530. If the monitoring apparatus 70 is found to escape the assigned area of monitoring operations, a warning of false location is given immediately and a guiding message of correction is given as well, especially when the monitored values of the monitored data deviate from normal values.

For example, by on-site visual results, it is apparent that a monitored value exceeds the threshold value with unreasonable low value or even being zero. Such situation happens when the monitoring apparatus 70 is abnormal. The situation is found automatically by the second storage unit 554, and the data of monitoring operations is sent by the message device 552 for displaying on the management operation unit 548 and on the monitoring apparatus 70 that sent the data of monitoring operations. Thereby, the managerial personnel and the executive monitoring personnel can adopt corresponding calibration and adjustment. The monitored data and the positioning data collected by the data processing apparatus 52 are still stored to the data storage unit 528 and the positioning data storage unit 530 of the data processing apparatus 52. However, the data processing apparatus will mark the monitored data as problematic data for preventing misemploy.

Figure 7:
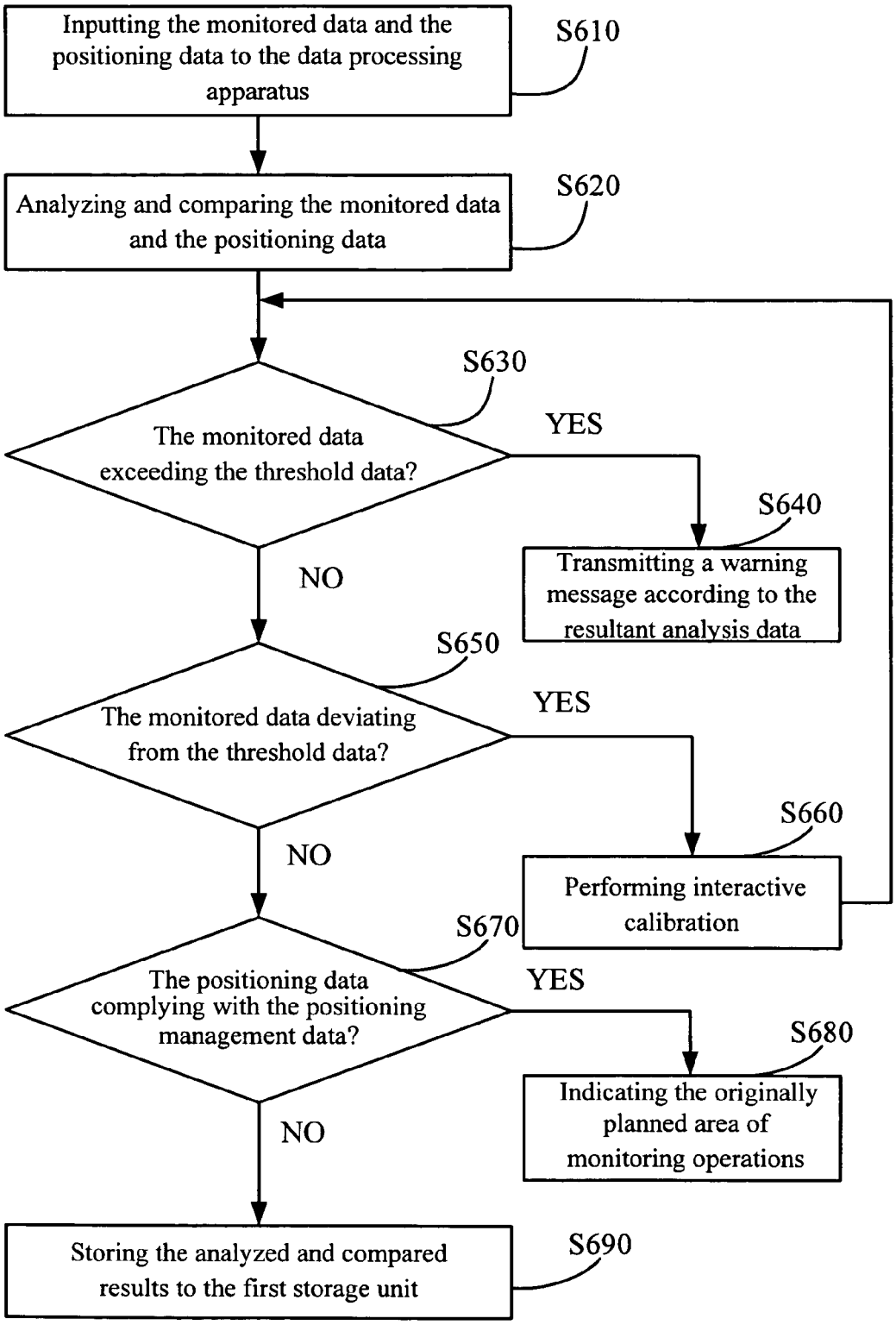
FIG. 7 shows a flowchart for judging monitored data according to a preferred embodiment of the present invention.

FIG. 7 shows a flowchart for analyzing monitored data according to a preferred embodiment of the present invention. As shown in the figure, the management method for environmental monitoring according to the present invention further explains how to feedback the evaluation and decision to the monitoring apparatus 70 for the server system, and how to adjust and modify interactively the monitoring items for environmental monitoring and the corresponding area of monitoring operations. At first, as the step S610 shows, input the monitored data to the data processing apparatus 52 through the input unit of monitored data 526, where the monitored data input to the data processing apparatus 52 owns integrity for complying with the area of monitoring operations according to the planning of monitoring operations. Then, following the step S620, convert the monitored data to monitored data and positioning data by the data processing unit 522 and store them to the data storage unit 528 and the positioning data storage unit 530, respectively. The data processing unit 522 analyzes and compares the monitored data in accordance with the monitoring management data of the data storage unit 528 and the positioning management data of the positioning data storage unit 530 simultaneously for judging the monitored data to be normal, exceeding danger constraint value, deviating the positioning management data, or the location of actual environmental monitoring not conforming to the positioning management data.

Afterwards, following the step S630, judge if the monitored values of the monitored data exceed the threshold values of the positioning management data. If so, then the step S640 is executed. Otherwise, the step S650 is executed. In the step S640, different warnings corresponding to different danger levels of environmental pollution are displayed on the management operation unit 548. It is chosen to transmit a warning signal directly and simultaneously to the monitoring apparatus 70, or to notify after confirmation by the managerial personnel via the management operation unit 548. In order to avoid ignorance of the managerial personnel, if the warning signal is not transmitted to the monitoring apparatus 70 after a set time duration, then the first management apparatus 54 will transmit the warning signal to the monitoring apparatus 70 automatically. Moreover, the data processing apparatus 52 can provide evacuation directions and guiding messages according to the requirements of the monitoring apparatus 70, and said evacuation directions and guiding messages are transmitted to the monitoring apparatus 70 by the first management apparatus 54.

Next, following the step S650, judge if the monitored data deviates from the threshold data. If so, then the step S660 is executed. Otherwise, the step S670 is executed. In the step S660, transmit immediately the monitored data to the message device 552, integrate corresponding data of monitoring operations from the second storage unit 552 according to the deviation extent of the monitored data, and display descriptive information, which describes the situation of deviation, of the corresponding deviated monitored data on the management operation unit 548. The managerial personnel of the management operation unit 548 can decide whether to feedback the analyzed and compared results by the data processing apparatus 52 to the evaluation and decision personnel, or to notify them after having set up deviation ratio and frequency. In order to prevent disturbance on the server system 50 owing to excess such messages, the managerial personnel of the management operation unit 548 can set threshold parameters of deviation ratio and frequency according to circumstances. When the analyzed and compared results reach the threshold parameters, the message describing that the monitored data exceeds the threshold data will be displayed. According to the analyzed and compared results, the managerial personnel can judge whether to select going to feedback evaluation and decision and to interactive operation of environmental monitoring. If feedback evaluation and decision is selected, the analyzed and compared results will be stored to the data storage unit 528, and the server system 50 will transmit interactive message to the evaluation and decision personnel. If action modification of environmental monitoring is selected, it is regarded as the feedback analyzed and compared results and will be recorded in the data storage unit 528. The server system 50 will submit a message of requesting modification simultaneously to the evaluation and decision personnel.

Then, in the step S660, the management operation unit 548 will display pictures of modifying execution items of environmental monitoring and selecting area of monitoring operations. By direct selecting, the area of monitoring operations can be modified, which zooms in or zoom out with fixed aspect ratio according to the original planning range, and re-inputs planning of and area of monitoring operations. For avoiding disturbance, this task can be executed only in the server system 50. Besides, the evaluation and decision personnel can undergo planning of monitoring operations and the corresponding area thereof in the second management apparatus 60, and send them back to the server system 50 via the network 80. Then, the managerial personnel of the management operation unit 548 can refer to the planning of monitoring operations. In addition, the management operation unit 548 will display influenced monitoring apparatuses, and transmit interactive calibration information to the monitoring apparatuses to be modified simultaneously for performing modification operations real-timely.

Moreover, in the step S660, after interactive modifications, the monitored data of the monitoring apparatus 70 performs adjustments in accordance with interactively calibrated monitoring threshold data. Then, the step S630 is re-executed for discovering if the overall monitored data increases by means of re-analyzing and re-comparing by the data processing unit 522. If it does, it means that the operators of the monitoring apparatus 70 will encounter dangers if environmental monitoring continues. Thereby, the step S640 is executed to transmit a warning signal to the monitoring apparatus, and the evacuation guiding direction is transmitted to the monitoring apparatus 70. If the positioning data of the monitored data deviates from the positioning management data, then the area of monitoring operations re-planned by the data processing apparatus 52 is transmitted to the monitoring apparatus 70 for providing the monitoring apparatus 70 with direction guidance for turning to the re-planned area of monitoring operations. For example, the monitoring apparatus 70 first performs monitoring in a residential area according to industrial-standard environmental quality. It is thereby necessary to adjust the monitoring apparatus 70 interactively with the server system 50 so that the monitoring apparatus 70 changes to perform monitoring according to normal-standard environmental quality.

Next, following the step S670, judge if the positioning data of the monitored data complies with the positioning management data. If so, then the step S690 is executed. Otherwise, the step S680 is executed. In the step S680, a warning signal of false monitoring location, which does not include the message needing reply from the managerial personnel, is transmitted directly to the monitoring apparatus 70. The operators of the monitoring apparatus 70 return to the area of monitoring operation corresponding to the original planning of monitoring operations according to the received warning signal of false monitoring location. By means of the originally planned area of monitoring operations transmitted by the first management apparatus 54 to the monitoring apparatus 70, the direction guidance to the originally planned area of monitoring operations is provided to the monitoring apparatus 70. In the step S690, it is judged that the monitored values of the monitored data do not exceed the threshold data, and the monitored data does not deviate form the threshold data. Besides, the positioning data complies with the positioning management data. Thereby, the analyzed and compared results are stored to the corresponding monitored data, and are marked as normal data.

To sum up, the geographic management system for environmental monitoring provided by the present invention can solve execution problems after planning of monitoring operations in the past time. Thereby, the managerial personnel and users can master execution conditions of respective monitoring apparatuses real-timely and effectively. By linking and integrating related data, execution, management, evaluation and decision can be made interactively. Hence, monitoring efficiency, safety, and resultant quality can be enhanced.

Accordingly, the present invention conforms to the legal requirements owing to its novelty, unobviousness, and utility. However, the foregoing description is only a preferred embodiment of the present invention, not used to limit the scope and range of the present invention. Those equivalent changes or modifications made according to the shape, structure, feature, or spirit described in the claims of the present invention are included in the appended claims of the present invention.

The invention claimed is:

1. A management method with real-time interaction for environmental monitoring, comprising:

driving a monitoring apparatus to monitor an environmental quality, for producing monitored data and corresponding positioning data by the monitoring apparatus according to the environmental quality;

driving the monitoring apparatus to transmit the monitored data and the positioning data to a first management apparatus;

analyzing the monitored data and the positioning data collected by the first management apparatus according to threshold data and positioning management data stored in a data processing apparatus for producing analysis data by the data processing apparatus; and transmitting the analysis data to the monitoring apparatus by means of the first management apparatus;

wherein when the monitored data is greater than the threshold data, the analysis data produced by the data processing apparatus will include warning data.

2. The management method for environmental monitoring of claim 1, wherein the environmental quality includes an air quality, a radiation dose, or a water quality.

3. The management method for environmental monitoring of claim 1, wherein the warning data is a warning signal and evacuation direction data.

4. The management method for environmental monitoring of claim 1, wherein before the step of driving the monitoring apparatus to monitor an environmental quality, it further includes:

inputting the threshold data and the positioning management data to the data processing apparatus; and producing data of monitoring operations according to the threshold data and the positioning management data.

5. The management method for environmental monitoring of claim 4, wherein the data of monitoring operations includes a planning of monitoring operations and an area of monitoring operations.

6. The management method for environmental monitoring of claim 5, wherein the step of producing data of monitoring operations according to the threshold data and the positioning management data is converting the positioning management data for determining the planning of monitoring operations and the area of monitoring operations.

7. The management method for environmental monitoring of claim 1, wherein before the step of driving the monitoring apparatus to monitor an environmental quality, it further includes a step of driving the management apparatus to transmit data of monitoring operations to the monitoring apparatus.

8. The management method for environmental monitoring of claim 7, wherein the data of monitoring operations includes a planning of monitoring operations and an area of monitoring operations.

9. The management method for environmental monitoring of claim 7, wherein the step of driving the monitoring apparatus to monitor an environmental quality is to drive the monitoring apparatus to monitor a compound or a radiation material.

10. The management method for environmental monitoring of claim 7, wherein before the step of driving the management apparatus to transmit data of monitoring operations to the monitoring apparatus, it further includes a step of inquiring the operating status of the monitoring apparatus.

11. The management method for environmental monitoring of claim 10, wherein after the step of inquiring the operating status of the monitoring apparatus, it further includes a step of sending the monitoring operations of the monitoring apparatus according to the data of monitoring operations.

12. The management method for environmental monitoring of claim 1, wherein the step of driving the monitoring apparatus to transmit the monitored data and the positioning data to a first management apparatus further includes a step of driving the first management apparatus to examine the monitored data and the positioning data for judging integrity and rationality of the monitored data and the positioning data, and if the monitored data is not integral or not reasonable in comparison with the positioning data, a message of replenishing the monitored data is sent to the monitoring apparatus for driving the monitoring apparatus to replenish the monitored data.

13. The management method for environmental monitoring of claim 1, wherein the step of analyzing the monitored data and the positioning data collected by the first management apparatus according to threshold data and positioning management data stored in a data processing apparatus further analyzes the accuracy of the monitored data and the positioning management data, and when the monitored data deviates from the threshold data, the analysis data produced by the data processing apparatus will include monitoring calibration data.

14. The management method for environmental monitoring of claim 1, wherein the step of analyzing the monitored data and the positioning data collected by the first management apparatus according to threshold data and positioning management data stored in a data processing apparatus further analyzes the accuracy of the positioning data and the positioning management data, and when the positioning data deviates from the positioning management data, the analysis data produced by the data processing apparatus will include positioning calibration data.

15. The management method for environmental monitoring of claim 1, wherein the step of driving the monitoring apparatus to transmit the monitored data and the positioning data to a first management apparatus further drives the monitoring apparatus to transmit the monitored data and the positioning data to a second management apparatus for making the second management apparatus transmit the monitored data and the positioning data to the first management apparatus.

16. The management method for environmental monitoring of claim 1, wherein the step of transmitting the analysis data to the monitoring apparatus by means of the first management apparatus can further transmit the analysis data by means of the first management apparatus to a second management apparatus for making the second management apparatus transmit the analysis data to the monitoring apparatus.

17. The management method for environmental monitoring of claim 1, wherein the monitoring apparatus is a fixed monitoring apparatus or a mobile monitoring apparatus.

18. A management system with real-time interaction for environmental monitoring, comprising:

a monitoring apparatus, including a monitoring unit, a positioning unit, and a first connection unit, the monitoring unit monitoring an environmental quality, the monitoring apparatus producing monitored data according to the monitored result on the environmental quality, and the positioning unit producing positioning data corresponding to the monitored data; and a server system, comprising:

a data processing apparatus, including a data processing unit and a first storage unit, the first storage unit storing positioning management data and threshold data, the data processing unit analyzing the monitored data and the positioning data according to the threshold data and the positioning management data, and the data processing unit producing analysis data according to the analysis results of the monitored data and the positioning data;

a first management apparatus, connecting to the data processing apparatus, the first management apparatus including a second connection unit and a management unit, the management unit connecting to the second connection unit, the second connection unit connecting to the first connection unit, the management unit transmitting the analysis data to the monitoring apparatus, and the first management apparatus receiving the monitored data and the positioning data transmitted by the monitoring apparatus.

19. The management system for environmental monitoring of claim 18, wherein the environmental quality includes an air quality, a radiation dose, or a water quality.

20. The management system for environmental monitoring of claim 18, wherein the monitoring apparatus is a fixed monitoring apparatus or a mobile monitoring apparatus.

21. The management system for environmental monitoring of claim 18, wherein the first management apparatus further connects to a second management apparatus, which receives the analysis data transmitted by the first management apparatus and the monitored data and the positioning data transmitted by the monitoring apparatus, the second management apparatus transmits the analysis data to the monitoring apparatus, and the second management apparatus transmits the monitored data and the positioning data to the first management apparatus.

22. The management system for environmental monitoring of claim 21, wherein the second management apparatus connects to the first management apparatus via a network.

23. The management system for environmental monitoring of claim 22, wherein the network is the Internet, the intranet, or a combination of both.

24. The management system for environmental monitoring of claim 21, wherein the first management apparatus adopts Transmission Control Protocol/Internet Protocol (TCP/IP) for connecting to the second management apparatus via the network.

25. The management system for environmental monitoring of claim 18, wherein the management unit includes a message device and a second storage unit, the second storage unit storing data of monitoring operations, the message device reading the data of monitoring operations stored in the second storage unit according to the threshold data and the positioning management data, and the message device transmitting the data of monitoring operations to the monitoring apparatus.

26. The management system for environmental monitoring of claim 18, wherein the management unit includes a message device, which produces data of monitoring operations according to the threshold data and the positioning management data, and the message device transmits the data of monitoring operations to the monitoring apparatus.

27. The management system for environmental monitoring of claim 18, wherein once the positioning data is analyzed not to comply with the positioning management data by the data processing unit, the first management apparatus will be driven to transmit positioning calibration data to the monitoring apparatus.

28. The management system for environmental monitoring of claim 27, wherein the data processing unit analyzes the interactively calibrated monitored data according to the interactively calibrated threshold data, and when the interactively calibrated monitored data is greater than the interactively calibrated threshold data, the management unit will be driven to transmit warning data to the monitoring apparatus.

29. The management system for environmental monitoring of claim 18, wherein the data of monitoring operations includes a planning of monitoring operations and an area of monitoring operations.

30. The management system for environmental monitoring of claim 18, wherein once the monitored data is analyzed to deviate form the threshold data by the data processing unit, the management unit will be driven to transmit monitoring calibration data to the monitoring apparatus.

31. The management system for environmental monitoring of claim 18, wherein the first connection unit connects to the second connection unit via a network.

32. The management system for environmental monitoring of claim 18, wherein the first management apparatus further includes a network service unit and a management operation unit, the management operation unit connecting to the network service unit, the network service unit connecting to the network via the second connection unit, the management operation unit connecting to the data processing apparatus, the monitoring apparatus connecting to the network service unit via the network, the monitoring apparatus login to the server system via the network service unit, and the management operation unit displaying the operating status of the server system and the monitoring apparatus.

33. The management system for environmental monitoring of claim 32, wherein the network is the Internet, the intranet, or a combination of both.

34. The management system for environmental monitoring of claim 32, wherein the first connection unit and the second connection unit adopt Transmission Control Protocol/Internet Protocol (TCP/IP) for connecting to each other via the network.

35. The management system for environmental monitoring of claim 32, wherein the first connection unit and the second connection unit adopt the network interface of General Packet Radio Service (GPRS), Personal Handyphone System (PHS), Code Division Multiple Access (CDMA), Wireless Fidelity (WiFi), or Worldwide Interoperability for Microwave Access (WiMAX) for connecting to each other.

* * * * *